US011572142B2

(12) United States Patent
Haynes et al.

(10) Patent No.: US 11,572,142 B2
(45) Date of Patent: Feb. 7, 2023

(54) LIFE RAFT CANOPY WITH SPRING WIRE FRAME

(71) Applicant: Goodrich Corporation, Charlotte, NC (US)

(72) Inventors: Timothy C Haynes, Prescott Valley, AZ (US); Michael A Luzader, Laveen, AZ (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 17/494,647

(22) Filed: Oct. 5, 2021

(65) Prior Publication Data

US 2022/0024550 A1 Jan. 27, 2022

Related U.S. Application Data

(62) Division of application No. 16/509,383, filed on Jul. 11, 2019, now Pat. No. 11,148,770.

(51) Int. Cl.

| | |
|---|---|
| ***B63C 9/03*** | (2006.01) |
| ***B63C 9/04*** | (2006.01) |
| *B63B 35/62* | (2006.01) |

(52) U.S. Cl.

CPC ..... *B63C 9/03* (2013.01); *B63C 9/04* (2013.01); *B63B 35/62* (2013.01); *B63C 2009/042* (2013.01); *B63C 2009/046* (2013.01)

(58) Field of Classification Search

CPC .. B63C 9/02; B63C 9/026; B63C 9/03; B63C 9/035; B63C 9/04; B63C 9/044; B63C 2009/035; B63C 2009/042; B63C 2009/046; B63B 35/62

USPC ..... 441/35, 38, 40, 42, 47, 54

See application file for complete search history.

(56) References Cited

U.S. PATENT DOCUMENTS

| | | | | |
|---|---|---|---|---|
| 3,574,875 | A * | 4/1971 | Tulett | B63C 9/02 441/40 |
| 3,843,983 | A | 10/1974 | Tangen | |
| 4,678,443 | A * | 7/1987 | Edwards | B63C 9/04 441/40 |
| 4,825,892 | A | 5/1989 | Norman | |
| 4,998,900 | A | 3/1991 | Wright | |
| 5,038,812 | A | 8/1991 | Norman | |
| 5,467,794 | A | 11/1995 | Zheng | |

(Continued)

FOREIGN PATENT DOCUMENTS

| | | |
|---|---|---|
| GB | 1167294 | 10/1969 |
| GB | 2171960 | 9/1986 |

OTHER PUBLICATIONS

USPTO, Advisory Action, dated Feb. 8, 2021 in U.S. Appl. No. 16/509,383.

(Continued)

*Primary Examiner* — Daniel V Venne

(74) *Attorney, Agent, or Firm* — Snell & Wilmer L.L.P.

(57) ABSTRACT

A life raft may include a base comprising a first side and a second side, and a self-supporting, collapsible spring canopy. The canopy may include a spring wire frame, a first panel circumscribed by the spring wire frame, and a second panel circumscribed by the spring wire frame. A method of manufacturing a life raft arrangement includes folding the canopy, inserting the canopy into a storage pouch, and coupling the storage pouch to a life raft.

3 Claims, 8 Drawing Sheets

(56) References Cited

U.S. PATENT DOCUMENTS

| | | | | |
|---|---|---|---|---|
| 5,993,275 | A * | 11/1999 | Lavorata | B63C 9/04 114/345 |
| 6,206,743 | B1 | 3/2001 | Martin | |
| 6,302,127 | B1 | 10/2001 | Gayton | |
| 6,325,688 | B1 | 12/2001 | Martin | |
| 6,375,529 | B1 | 4/2002 | Infante | |
| 6,694,994 | B1 | 2/2004 | Zheng | |
| 6,881,114 | B2 | 4/2005 | Zheng | |
| 6,901,940 | B2 | 6/2005 | Zheng | |
| 7,152,733 | B2 | 12/2006 | Trickett | |
| 7,178,538 | B2 | 2/2007 | Ransom | |
| 7,225,823 | B1 | 6/2007 | Ransom | |
| 8,382,541 | B1 | 2/2013 | Campbell | |
| 8,851,956 | B2 | 10/2014 | Niu | |
| 9,162,738 | B1 | 10/2015 | Faletra | |

OTHER PUBLICATIONS

USPTO, Final Rejection, dated Nov. 30, 2020 in U.S. Appl. No. 16/509,383.
USPTO, Non-Final Rejection, dated Mar. 12, 2021 in U.S. Appl. No. 16/509,383.
USPTO, Non-Final Rejection, dated Aug. 14, 2020 in U.S. Appl. No. 16/509,383.
USPTO, Requirement for Restriction Election dated Jun. 5, 2020 in U.S. Appl. No. 16/509,383.
USPTO, Notice of Allowance dated Jun. 3, 2021 in U.S. Appl. No. 16/509,383.

* cited by examiner

LIFE RAFT CANOPY WITH SPRING WIRE FRAME

CROSS REFERENCE TO RELATED APPLICATIONS

This application is a divisional of, and claims priority to, and the benefit of U.S. patent application Ser. No. 16/509,383, filed on Jul. 11, 2019, and entitled "LIFE RAFT CANOPY WITH SPRING WIRE FRAME" which is incorporated by reference herein in its entirety for all purposes.

FIELD

The present disclosure relates to aircraft evacuation assemblies, and more specifically to a life raft canopy.

BACKGROUND

In the event of an emergency water landing, aircraft typically have one or more life rafts that can be deployed to hold evacuated passengers. Conventional rafts may be either deployed in a specific orientation to prevent inflation in an inverted position or may be able to be manually righted after an inverted deployment.

SUMMARY

A life raft arrangement is disclosed, comprising a base comprising a first side and a second side, and a canopy comprising a spring wire frame forming a first loop and a second loop, the first loop of the spring wire frame circumscribing a first panel of the canopy and the second loop of the spring wire frame circumscribing a second panel of the canopy, wherein the canopy is self-supported via the spring wire frame.

In various embodiments, the base comprises an inflatable border tube defining an inflatable volume.

In various embodiments, the spring wire frame intersects itself at an apex of the canopy.

In various embodiments, the spring wire frame is formed into a figure eight.

In various embodiments, the spring wire frame is disposed in a sleeve.

In various embodiments, the canopy further comprises a third panel extending between the first loop and the second loop.

In various embodiments, the canopy is removably coupled to the base.

In various embodiments, the canopy is removably coupled to the inflatable border tube.

In various embodiments, the life raft arrangement further comprises a storage pouch configured to contain the canopy.

In various embodiments, the storage pouch is configured for use as a receptacle for removing water from a life raft.

A life raft arrangement is disclosed, comprising a base comprising a first side and a second side, and a self-supporting, collapsible spring canopy, comprising a spring wire frame, a first panel circumscribed by the spring wire frame, and a second panel circumscribed by the spring wire frame.

In various embodiments, the base comprises an inflatable border tube defining an inflatable volume.

In various embodiments, the spring wire frame intersects itself at an apex of the canopy.

In various embodiments, the spring wire frame is formed into a figure eight.

In various embodiments, the spring wire frame is disposed in a sleeve.

In various embodiments, the canopy further comprises a third panel extending between the first panel and the second panel.

In various embodiments, the canopy is removably coupled to the inflatable border tube.

In various embodiments, the life raft arrangement further comprises a storage pouch configured to contain the canopy, wherein the storage pouch is configured for use as a receptacle for removing water from a life raft.

A method of manufacturing a life raft arrangement is disclosed, comprising folding a canopy, inserting the canopy into a storage pouch, and coupling the storage pouch to a life raft, wherein the canopy comprises a spring wire frame forming a first loop and a second loop, the first loop of the spring wire frame circumscribing a first panel of the canopy and the second loop of the spring wire frame circumscribing a second panel of the canopy.

In various embodiments, the canopy is self-supported via the spring wire frame.

The foregoing features and elements may be combined in various combinations without exclusivity, unless expressly indicated herein otherwise. These features and elements as well as the operation of the disclosed embodiments will become more apparent in light of the following description and accompanying drawings.

Figure 1:
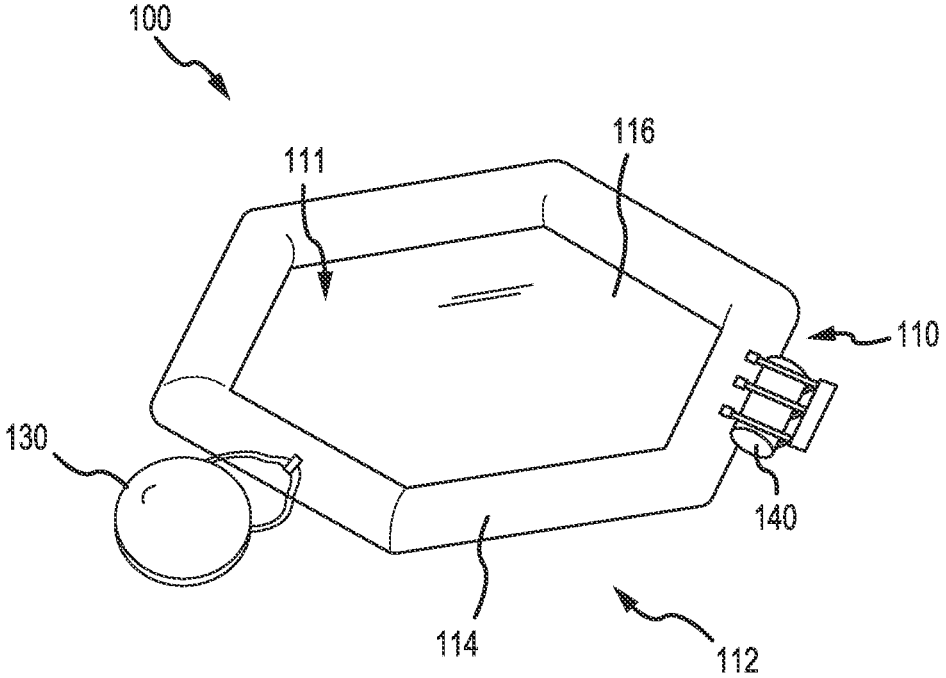
FIG. 1 is a perspective view of a life raft with a self-supporting, spring canopy stored in a storage bag coupled to the life raft, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not be necessarily be repeated herein for the sake of clarity.

In the event of an emergency water landing, aircraft typically have one or more life rafts that can be deployed to hold evacuated passengers. In various embodiments, and with reference to FIG. 1, the present disclosure provides a life raft 100 that includes a canopy 150 (also referred to herein as a self-supporting, collapsible spring canopy) that can be stored away when not in use and readily erected when desired. That is, in various embodiments, the canopy 150 may be moved between an open or expanded position, such as is shown in FIG. 2A, or a folded position (see FIG. 1), in which canopy 150 is collapsed into a size which is much smaller than its open position, as described in greater detail below. Accordingly, the life raft 100 may be utilized and deployed without stand-alone canopy support structure on both sides of the life raft, thereby decreasing the complexity of the life raft, decreasing the weight of the life raft, and decreasing the cost of the life raft, according to various embodiments. A canopy, as disclosed herein, may include a plurality of panels for added protection from the elements and further increases structural rigidity of the canopy for wind resistance.

Figure 2A:
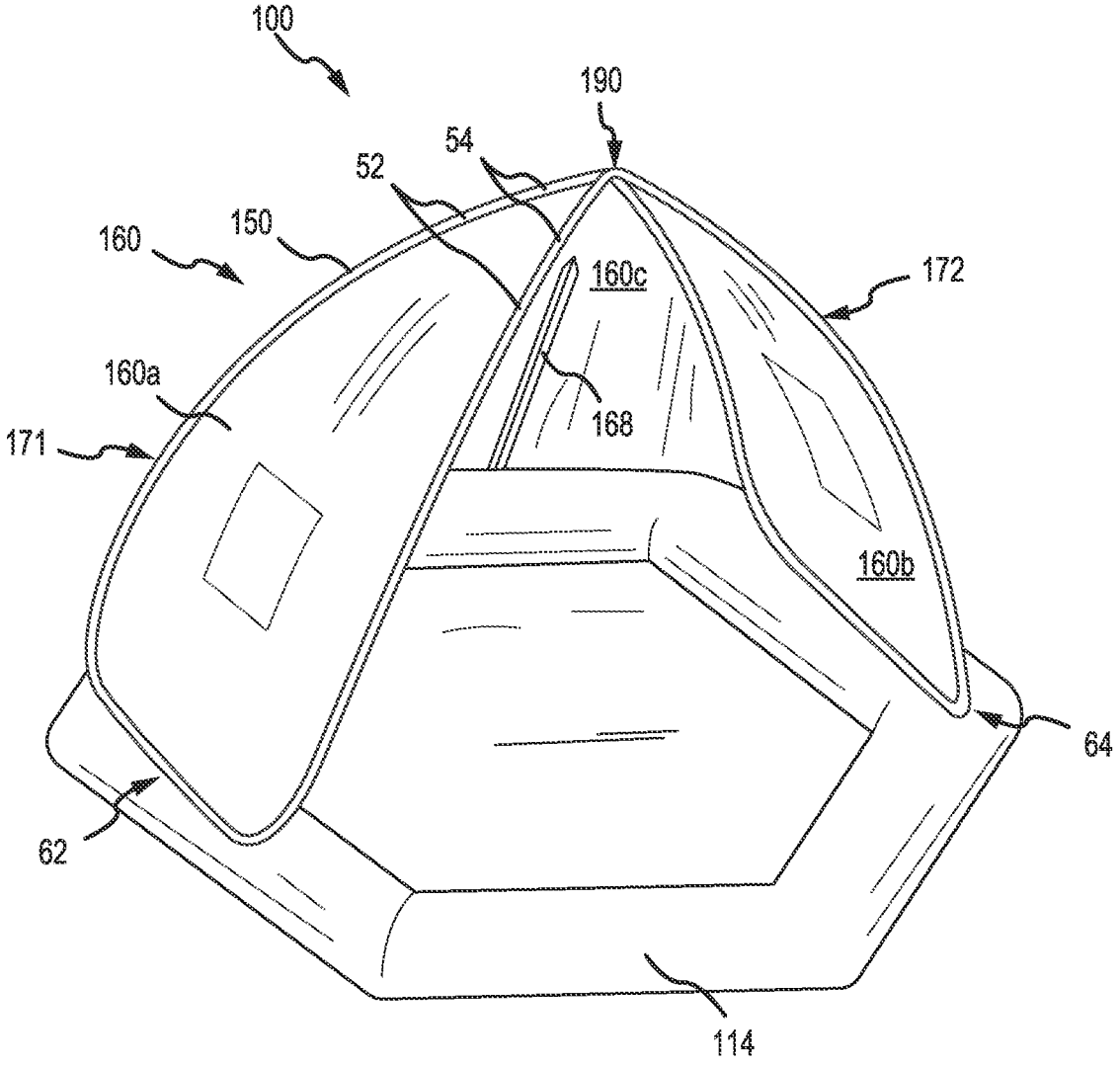
FIG. 2A is a perspective view of a life raft with the self-supporting, spring canopy in a deployed position, in accordance with various embodiments.

In various embodiments, and with reference to FIG. 1 and FIG. 2A, life raft 100 generally includes a base 110, and the canopy 150. The base 110 has a first side 111 and a second side 112 opposite the first side 111. In various embodiments, the first side 111 or the second side 112 of the base 110 of the life raft 100 may be a top surface of the life raft 100 upon which passengers are supported in response to the life raft 100 being deployed in water. That is, the base 110 of the life raft 100 may be inflatable, and the base 110 may include one or more inflatable border tubes 114. The inflatable border tube 114 may provide buoyancy to the life raft 100. The inflatable border tube 114 may circumscribe the first side 111 of the base 110. The inflatable border tube 114 may circumscribe the second side 112 of the base 110.

In various embodiments, and with continued reference to FIG. 1, the inflatable border tube 114 of the base 110 defines an inflatable volume. In various embodiments, the life raft 100 may include a charge cylinder 140 coupled to the inflatable border tube 114. The charge cylinder 140 may be configured to deliver air and/or other fluid into the inflatable border tube 114.

In various embodiments, life raft 100 may generally comprise a hexagonal shape. That is, inflatable border tube 114 may define a hexagonal shape. However, life raft 100 may generally comprise a circular shape, a rectangular shape, a pentagonal shape, an octagonal shape, a nonagonal shape, or a decagonal shape, among others.

In various embodiments, life raft 100 may include a floor 116 circumscribed by the inflatable border tube 114. The floor 116 may be supported by inflatable border tube 114. Life raft 100 may be made from a fabric material, a plastic material, or a composite material, among others. For example, inflatable border tube 114 and/or floor 116 may be made from nylon or a nylon material coated with a thermoplastic material, among others.

Figure 3:
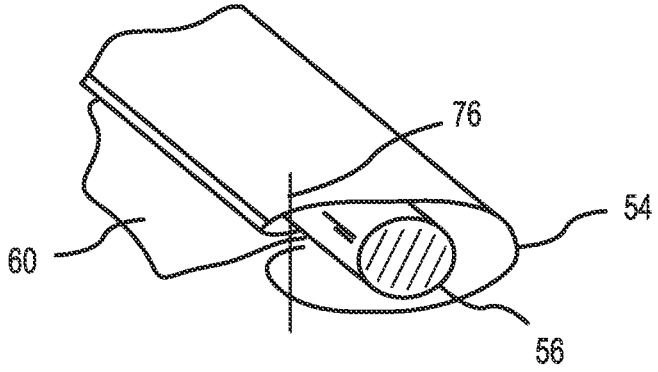
FIG. 3 is a cross-section view of a spring wire frame installed in a canopy, in accordance with various embodiments.
Figure 6A:
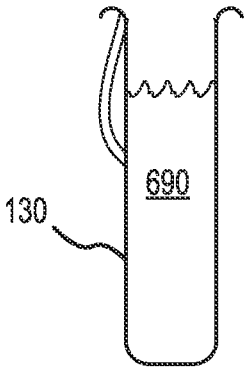
FIG. 6A and FIG. 6B are schematic views of the storage pouch of FIG. 1 being used as a receptacle for removing water from the life raft, in accordance with various embodiments.
Figure 6B:
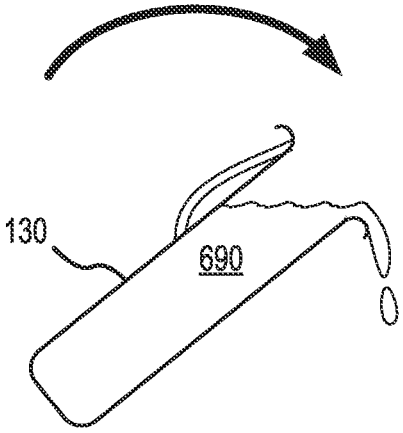

In various embodiments, life raft 100 may include a storage pouch 130. With combined reference to FIG. 1, FIG. 2A, and FIG. 3 canopy 150 may be contained within storage pouch 130 until the canopy 150 is deployed. In various embodiments, storage pouch 130 is configured for use as a receptacle (see FIG. 6A) for removing water from the life raft 100 (see FIG. 6B) when canopy 150 is removed therefrom. For reversible life rafts, attachment provisions may be installed to permit the canopy 150 to be installed on either side of the life raft (e.g., see FIG. 4, FIG. 7A, and FIG. 7B). Canopy 150 may be folded into a collapsed position for storage and may be unfolded into an erect or deployed position for use as a canopy.

Figure 2B:
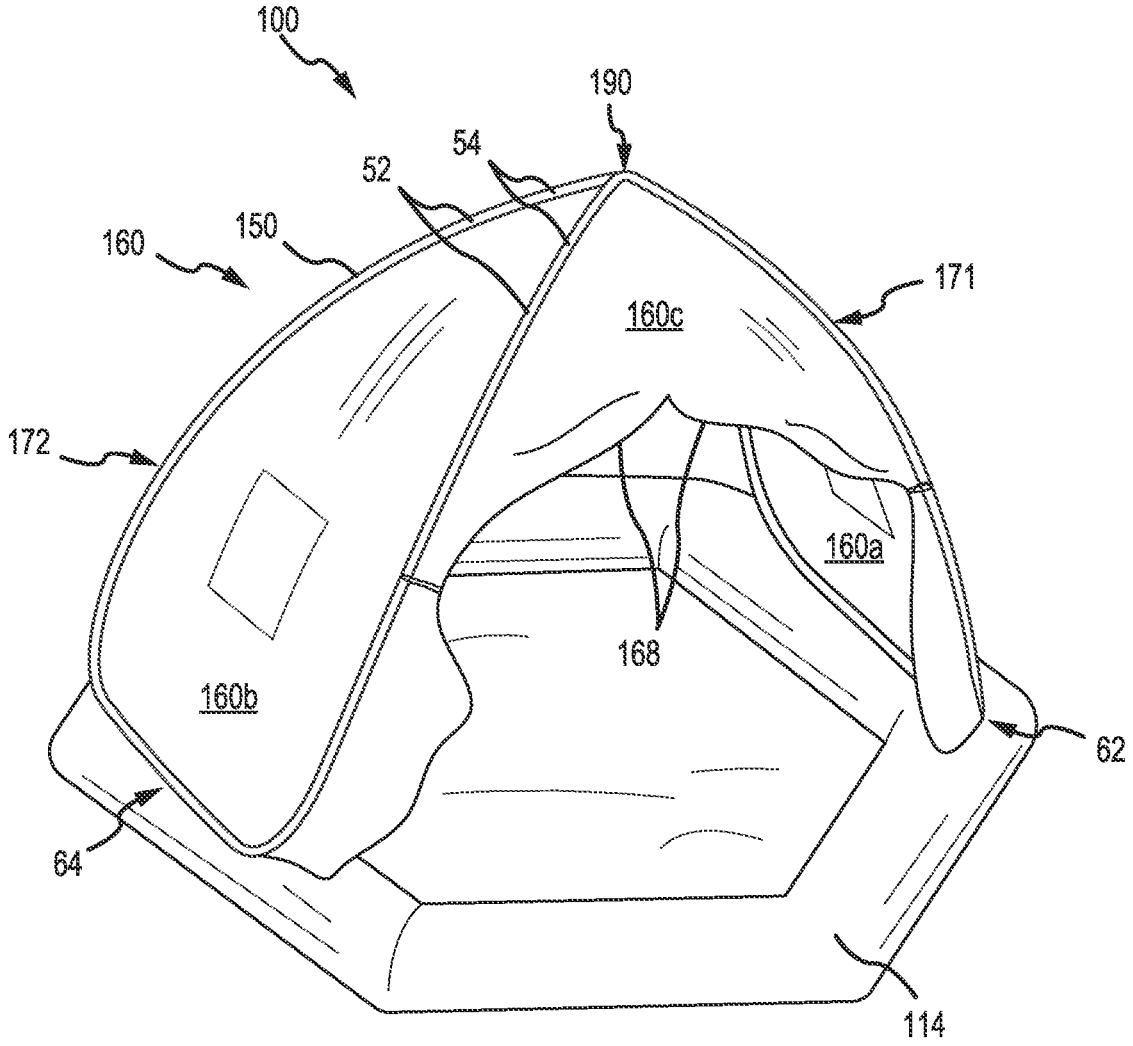
FIG. 2B is a perspective view of a life raft with the self-supporting, spring canopy in a deployed position, looking from the opposite direction than the view of FIG. 2A and with a third panel in an open position, in accordance with various embodiments.

Canopy 150 may comprise a plurality of panels 160 (e.g., first panel 160*a*, second panel 160*b*, and third panel 160*c*). One or more panels 160 may have a peripheral edge 52 that is defined by a peripheral frame retaining sleeve 54. A spring wire frame 56 is retained or held within the frame retaining sleeve 54 such that the spring wire frame 56 extends completely around the peripheral edge 52. In various embodiments, spring wire frame 56 is in the form of a "figure eight" when in the erect position. As used herein, the term "figure eight" may refer to the shape of the Arabic numeral "8." Stated differently, the term "figure eight" may refer to a figure or form composed of two loops formed by a continuous line crossing itself. In various embodiments, spring wire frame 56 forms a first loop 171 and a second loop 172. Spring wire frame 56 may intersect itself at an apex 190 of the canopy 150. The first loop 171 of the spring wire frame 56 may circumscribe the first panel 160*a* and the second loop 172 of the spring wire frame 56 may circumscribe the second panel 160*b*. The third panel 160*c* may extend between first loop 171 and second loop 172. Stated differently, third panel 160*c* may extend between first panel 160*a* and second panel 160*b*. In this regard, first loop 171 may define a first side of third panel 160*c* and second loop 172 may define a second, opposing side of third panel 160*c*. The canopy 150 is self-supported via spring wire frame 56. In various embodiments, one or more panels may comprise portions that are moveable between open and closed positions. For example, the illustrated embodiment of FIG. 2A shows third panel 160*c* having a zip fastener 168 in a closed position. With reference to FIG. 2B, a view of canopy 150 looking from the opposite direction of FIG. 2A is illustrated with zip fastener 168 in an open position, in accordance with various embodiments. It is contemplated herein that other types of fasteners may be used in place, or in addition to, the zip fastener 168, including toggle fasteners, hook and loop fasteners, or the like. With respect to FIG. 2B, elements with like element numbering, as depicted in FIG. 2A, are intended to be the same and will not necessarily be repeated for the sake of clarity.

The spring wire frame 56 may be provided as one continuous loop, or may be a strip of material connected at both ends to form a continuous loop. The spring wire frame 56 may be formed of flexible coilable steel, although other materials such as plastics may also be used. The spring wire frame 56 should be made of a material which is relatively strong and yet is flexible to a sufficient degree to allow it to be coiled. Thus, the spring wire frame 56 is capable of assuming two positions, an open or expanded position such as shown in FIG. 2A, or a folded position (see FIG. 1) in which the frame member is collapsed into a size which is much smaller than its open position. For example, a canopy of dimensions 65"×59"×43.5" (L×W×H) may fold down to 17.7"×1.2" (Diameter×Height). The spring wire frame 56 may be merely retained within the frame retaining sleeve 54 without being connected thereto. In various embodiments, the frame retaining sleeve 54 may be mechanically fastened, stitched, fused, or glued to the spring wire frame 56 to retain the spring wire frame 56 in position.

A sheet material 60 extends within the internal space defined by the frame retaining sleeve 54, and is held taut by the spring wire frame 56 when the spring wire frame 56 is in its open position. The term "sheet material" should be made from strong, flexible yet lightweight materials and may include woven fabrics, sheet fabrics, meshed fabrics, nylons or even films. The sheet material 60 can be water-resistant and durable to withstand the wear and tear associated with harsh weather environments, and rough treatment by users. The sheet material 60 is attached to the frame retaining sleeve 54, which may be formed by folding a piece of fabric and applying a stitching 76.

Figure 4:
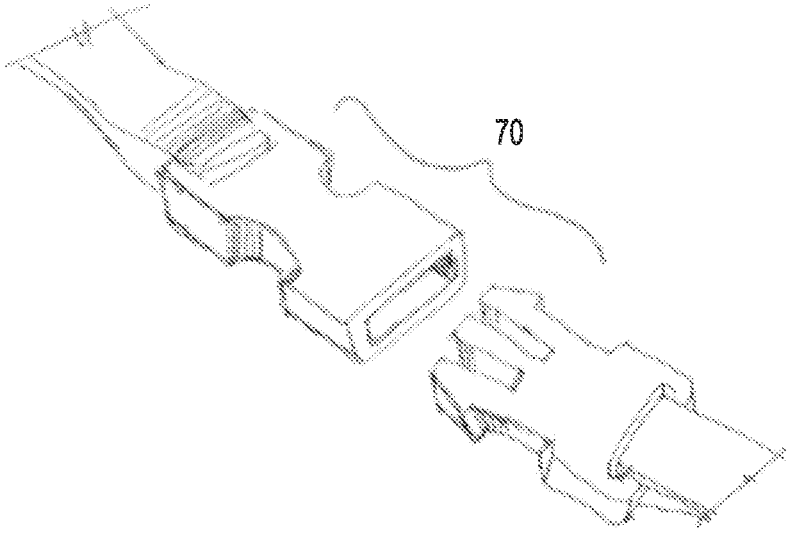
FIG. 4 is a perspective views of a snap buckle, in accordance with various embodiments.
Figure 7A:
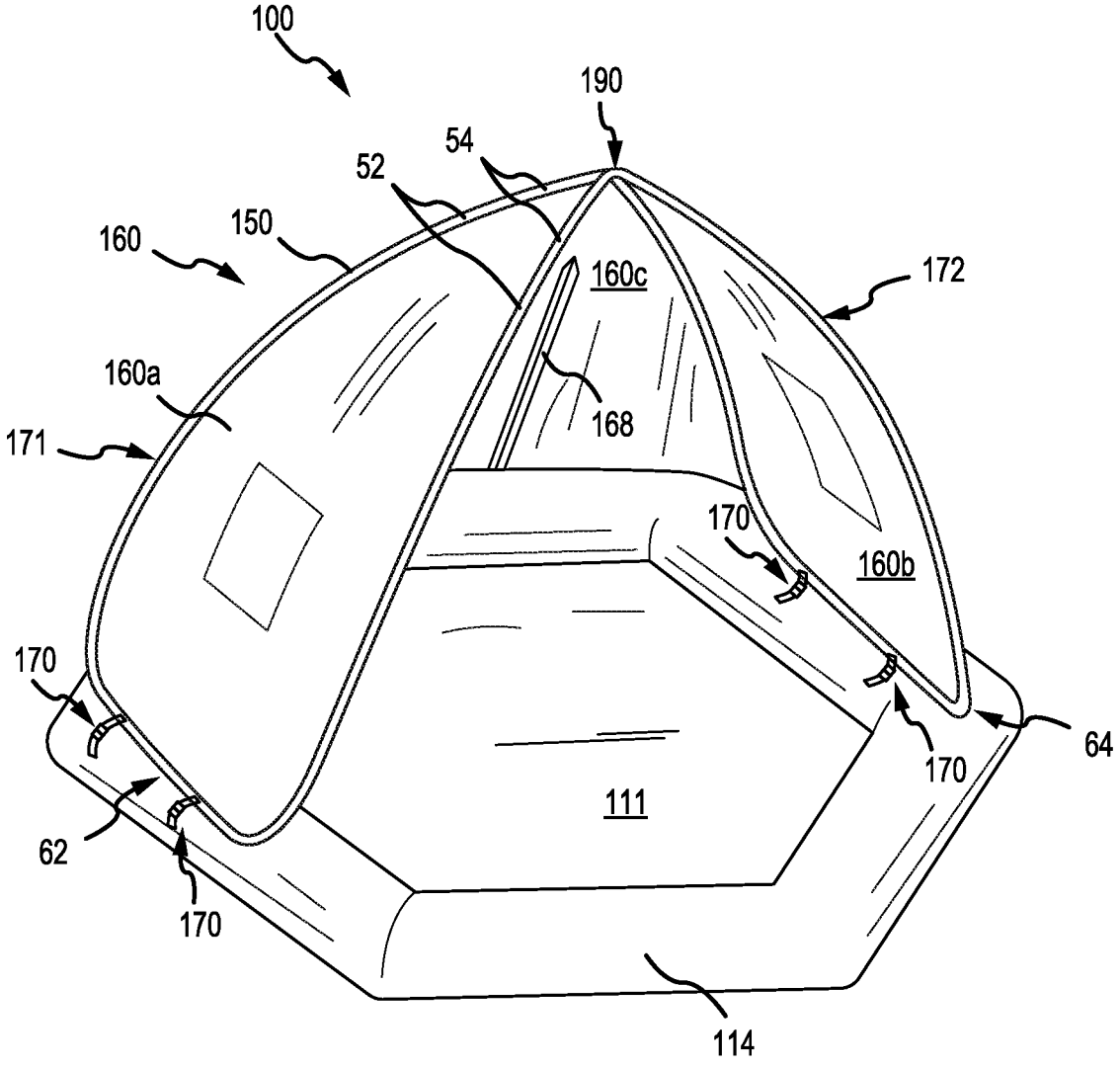
FIG. 7A and FIG. 7B are perspective views of the life raft of FIG. 2A with the self-supporting, spring canopy removably coupled to the first side and the second side, respectively, of the base via removable attachment mechanisms, in accordance with various embodiments.
Figure 7B:
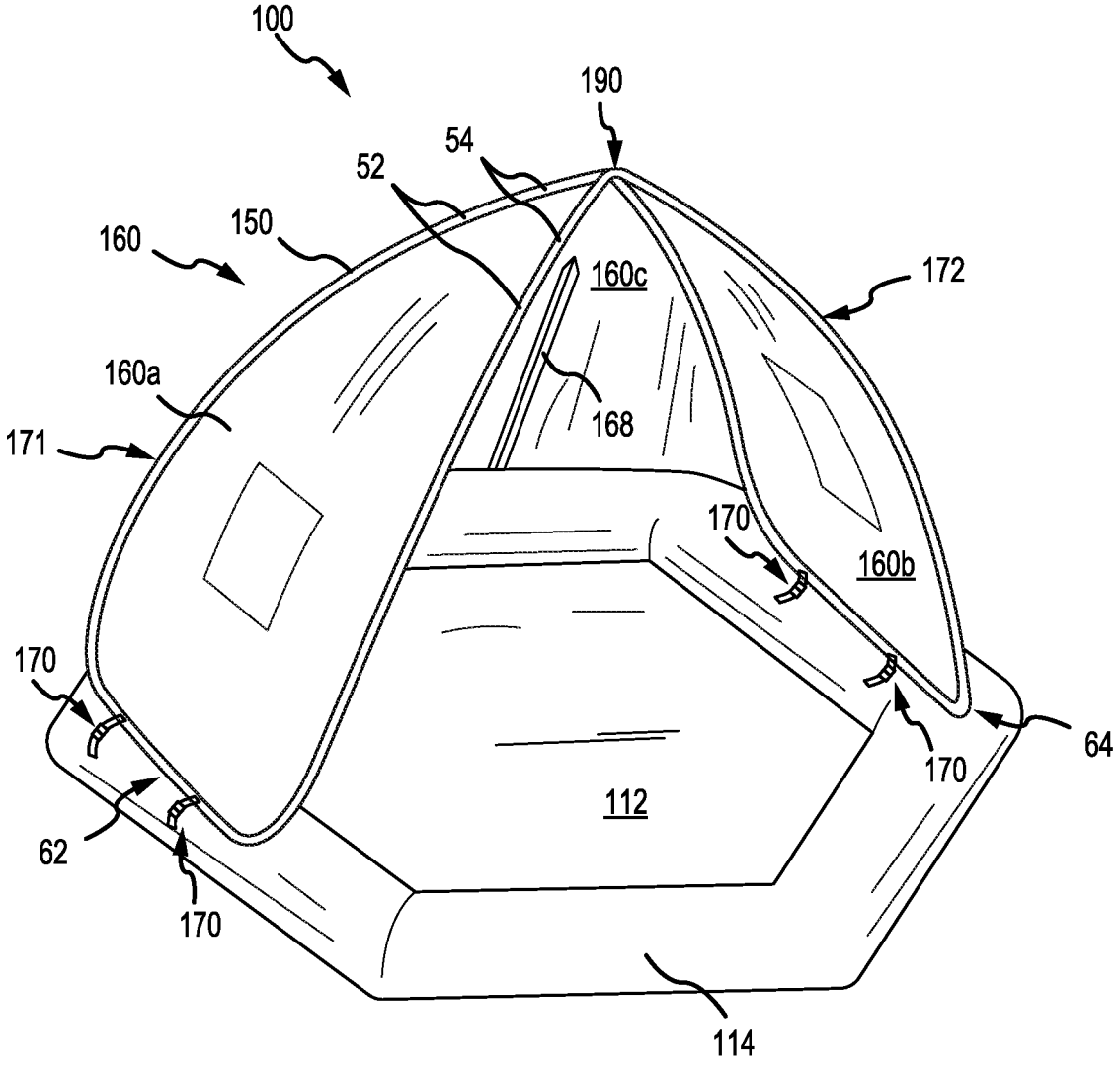

In various embodiments, each panel 160 may have a generally triangular configuration. First panel 160*a* and second panel 160*b* may have a base edge 62 and 64, respectively. Each base edge 62, 64 may be removably attached to inflatable border tube 114. FIG. 7A illustrates each base edge 62, 64 removably attached to the first side 111 of inflatable border tube 114 via a plurality of removable attachment mechanisms 170. FIG. 7B illustrates each base edge 62, 64 removably attached to the second side 112 of inflatable border tube 114 via the plurality of removable attachment mechanisms 170. For example, FIG. 4 illustrates the use of a snap buckle 70 to removably connect the base edges 62, 64 to the inflatable border tube 114. The removable connection between the base edges 62, 64 and inflatable border tube 114 can also be accomplished by other known removable attachment mechanisms, such as but not limited to hook and loop fasteners, hooks, toggles and latches. With respect to FIG. 7A and FIG. 7B, elements with like element numbering, as depicted in FIG. 2A, are intended to be the same and will not necessarily be repeated for the sake of clarity.

Figure 5:
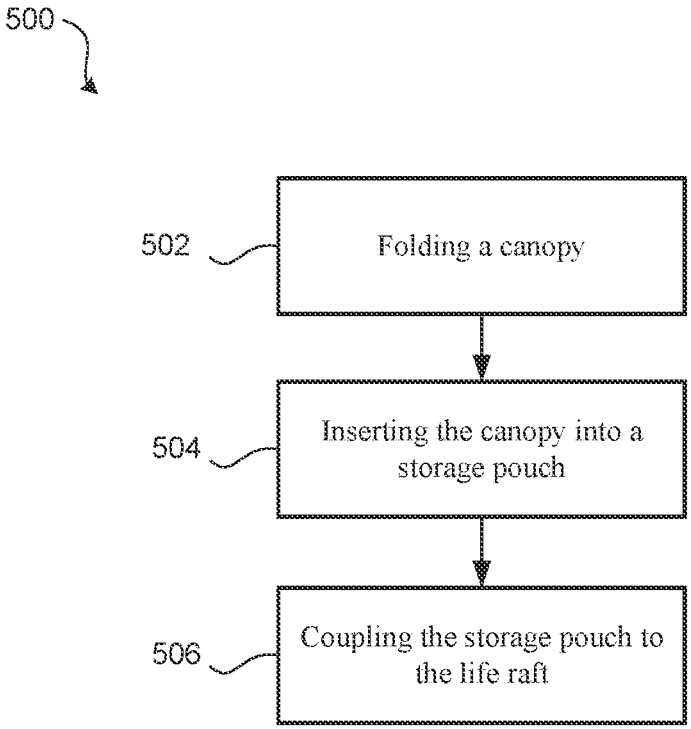
FIG. 5 is a schematic flow chart diagram of a method of manufacturing a life raft arrangement, in accordance with various embodiments.

With reference to FIG. 5, a method 500 for manufacturing a life raft arrangement may include folding a canopy (step 502). Method 500 may include inserting the canopy into a storage pouch (step 504). Method 500 may include coupling the storage pouch to the life raft (step 506).

With combined reference to FIG. 1, FIG. 2A, and FIG. 5, step 502 may include folding canopy 150. Step 504 may include inserting the folded canopy 150 into storage pouch 130. Step 506 may include coupling the storage pouch 130 to life raft 100 (see FIG. 1). Storage pouch 130 may be coupled to life raft 100 by use of a snap buckle (see FIG. 4), hook and loop fasteners, hooks, toggles, tethers, and/or latches, among other attachment features.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method of manufacturing a life raft arrangement, comprising:

folding a canopy;

inserting the canopy into a storage pouch; and coupling the storage pouch to a life raft, wherein the canopy comprises a spring wire frame forming a first loop and a second loop, the first loop of the spring wire frame circumscribing a first panel of the canopy and the second loop of the spring wire frame circumscribing a second panel of the canopy.

2. The method of claim 1, wherein the canopy is self-supported via the spring wire frame in response to being deployed.

3. The method of claim 1, wherein the canopy is configured to be removably coupled to the life raft at either of a first side of the life raft and a second side of the life raft, the first side being opposite the second side, such that the life raft is reversible.

* * * * *